US007959243B2

(12) United States Patent
Kasai et al.

(10) Patent No.: US 7,959,243 B2
(45) Date of Patent: Jun. 14, 2011

(54) PRINTHEAD, HEAD CARTRIDGE, AND PRINTING APPARATUS EMPLOYING EITHER OF SAME

(75) Inventors: Ryo Kasai, Setagaya-ku (JP); Masataka Sakurai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 579 days.

(21) Appl. No.: 11/764,705

(22) Filed: Jun. 18, 2007

(65) Prior Publication Data

US 2008/0001979 A1 Jan. 3, 2008

(30) Foreign Application Priority Data

Jun. 28, 2006 (JP) ..... 2006-178585

(51) Int. Cl.
*B41J 29/38* (2006.01)

(52) U.S. Cl. ..... 347/5; 347/9

(58) Field of Classification Search ..... 347/5, 9
See application file for complete search history.

(56) References Cited

U.S. PATENT DOCUMENTS

| | | | | |
|---|---|---|---|---|
| 6,761,424 | B2 * | 7/2004 | Murata | 347/14 |
| 2001/0009435 | A1 | 7/2001 | Nagumo | |
| 2006/0238558 | A1 * | 10/2006 | Hatasa et al. | 347/20 |
| 2007/0237243 | A1 * | 10/2007 | Fagan | 375/257 |

FOREIGN PATENT DOCUMENTS

| | | |
|---|---|---|
| EP | 1231059 | 8/2002 |
| EP | 1279503 | 1/2003 |
| JP | 10-166583 A | 6/1998 |
| JP | 2005-199665 | 7/2005 |

* cited by examiner

*Primary Examiner* — Julian D Huffman
(74) *Attorney, Agent, or Firm* — Canon USA Inc IP Division

(57) ABSTRACT

A printhead that minimizes increased size and cost of an apparatus by reducing a number of input pads, while making use of the advantages of employing a differential input circuit. This printhead has an input pad to which a differential signal obtained by superimposing two or more logic signals is input. The differential input circuit includes a circuit that disassembles the differential signal input via the input pad into separate logic signals.

7 Claims, 11 Drawing Sheets

PRINTHEAD, HEAD CARTRIDGE, AND PRINTING APPARATUS EMPLOYING EITHER OF SAME

BACKGROUND OF THE INVENTION

1. Field of the Invention

The present invention relates to a printhead, a head cartridge, and a printing apparatus employing either of the printhead and the head cartridge, suitable for use in inkjet printing in which ink droplets are discharged.

2. Description of the Related Art

An inkjet printing apparatus is configured so as to print information on a print medium by discharging printing ink from a plurality of fine nozzles of a printhead according to a print signal. An inkjet printing apparatus has advantages such as being capable of non-contact printing to a print medium such as print paper, easy conversion to color, and being abundantly quiet.

FIG. 1 is a block diagram showing a circuit configuration in a conventional printhead, and an example timing chart of signals transmitted to the printhead from a printing apparatus.

A DATA signal 101 (digital signal: image data) is serially input to a shift register 105 in synchronization with the edges of a CLK signal 102 (clock signal). The shift register 105 temporarily stores data that has been input, the data corresponding to heaters.

Next, when an LT signal 103 (latch signal) that is input to a latch circuit 106 goes low, the data stored in the shift register 105 is latched in the latch circuit 106. When the LT signal 103 goes high, the data latched in the latch circuit 106 is held.

When an HE signal 104 (heat enable signal) is input to a drive circuit 107 in a state with data being held, electric current flows to a heater corresponding to the data according to time, at a timing when the HE signal 104 goes low.

Printing is performed by repeatedly performing the above sort of data transfer and printhead driving.

On the other hand, at present, increased performance such as faster speed is sought for inkjet printing apparatuses. Thus, as a means for increasing printing speed, there are methods wherein the cycle in which ink is discharged from the nozzles is shortened. However, there are problems such as the fact that due to shortening that cycle, many signals are transmitted with high frequency, and thus there is an effect from radiated electromagnetic waves.

Also, in a thermal inkjet printing apparatus, in addition to a signal, a high current that is allowed to flow to a heater flows to the printhead by being transmitted through a long flexible cable or the like from the main body of the printing apparatus, and noise generated by this current interferes with the signal. There is a risk this will lead to malfunction of the head. Thus, it is necessary for a thermal inkjet printing apparatus to be robust with respect to noise caused by this current.

Consequently, a differential input circuit has been disclosed as one way of dealing with these problems (see Japanese Patent Publication Laid-open No. 10-166583).

In Japanese Patent Publication Laid-open No. 10-166583, two signals are input to the differential input circuit for one type of signal. Here, as an example of data transfer to the differential input circuit, a timing chart is shown in FIG. 2. Here, two signals (double-ended signals) CLK+ and CLK−, and DATA+ and DATA−, are provided for each of the CLK signal and the DATA signal, which require transfer at high frequency.

Because the double-ended signals use the differential of the ± signals, they can be transferred as signals with a smaller voltage amplitude than in the case of a conventional single-ended signal. Thus the electromagnetic radiation of those double-ended signals is less than when transmitting with a single-ended signal. Also, because these signals pass through a flexible cable or the like adjacent to each other, electromagnetic noise generated from the current of each signal is cancelled by the other, thus suppressing interference with the other signal.

Thus, electromagnetic radiation during high frequency signal transmission, which was a problem for accelerating printing speed, can be suppressed by adopting differential data transfer.

Also, differential data transfer is very robust with respect to external noise. Because a double-ended signal uses the differential of the ± signals, even if external noise is applied, the differential does not change provided that the same noise is applied to both the + and − signals, so the effect of noise can be ignored.

Thus, robustness with respect to noise caused by high current flowing to a heater is insured, so it is possible to prevent malfunction of the head.

However, because it is necessary with differential data transfer to use two signal lines to transfer signals conventionally transferred with one signal line, such a configuration leads to increased size of the apparatus and also increased costs, due to an increased number of input pads and an accompanying increase in wiring.

So, there is a desire to reduce the number of input pads, suppressing an increase in the number of input pads and an accompanying increased size and cost of the apparatus, while making use of the advantages of employing a differential input circuit.

SUMMARY OF THE INVENTION

The present invention is directed to a printhead, a head cartridge, and a printing apparatus.

A printhead, a head cartridge, or a printing apparatus in which either is used according to this invention is capable of minimizing increased size and cost of the apparatus by reducing the number of input pads, while making use of the advantages of employing a differential input circuit.

According to one aspect of the present invention, a printhead includes a logic circuit configured to drive a plurality of print elements with a plurality of logic signals, a differential input circuit configured to generate the plurality of logic signals in order to drive the logic circuit based on a differential signal input from outside; and an input pad to which the differential signal obtained by superimposing two or more logic signals is input. The differential input circuit includes a disassembling circuit that disassembles the differential signal input via the input pad into separate logic signals.

According to another aspect of the present invention, a head cartridge includes a printhead having a logic circuit configured to drive a plurality of print elements with a plurality of logic signals, and a differential input circuit configured to generate the plurality of logic signals in order to drive said logic circuit based on a differential signal input from outside; an ink tank in which ink is encapsulated; and an input pad to which the differential signal obtained by superimposing two or more logic signals is input. The differential input circuit includes a disassembling circuit that disassembles the differential signal input via the input pad into separate logic signals.

According to still another aspect of the present invention, a printing apparatus that performs printing using the printhead or the head cartridge, includes a first generating unit configured to generate three or more differing logic signals; a second generating unit configured to generate a differential signal obtained by superimposing at least two differing logic signals, using the three or more differing logic signals; and an output unit outputting the differential signal generated by the second generating unit to the printhead.

Further features of the present invention will become apparent from the following description of exemplary embodiments (with reference to the attached drawings).

DESCRIPTION OF THE EMBODIMENTS

In the examples described below, a printing apparatus is described, by way of example, that uses a printhead according to an inkjet system.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "link" includes a liquid which, when applied onto a print medium, can form images, figures, patterns, and the like, can process the print medium, and can process ink (e.g., can solidify or insolubilize a coloring agent contained in ink applied to the print medium).

Moreover, the term "printing element", if not specifically stated otherwise, broadly includes a discharge orifice and a fluid path in communication with that orifice, and an element that generates energy used for ink discharge.

The term "element substrate" used in this description indicates not simply a base constituted from a silicon semiconductor, but a base provided with elements, wiring, and the like. "On the element substrate" indicates not only on the surface of the element substrate, but may also refer to being on the surface of the element substrate or to being inside an element base in the vicinity of the surface of the element substrate. Also, the term "built-in" used in the invention is a term indicating not merely that separate elements are simply disposed on the base; this term indicates that elements are manufactured formed integrated on the element substrate with a semiconductor circuit manufacturing process or the like.

Figure 1:
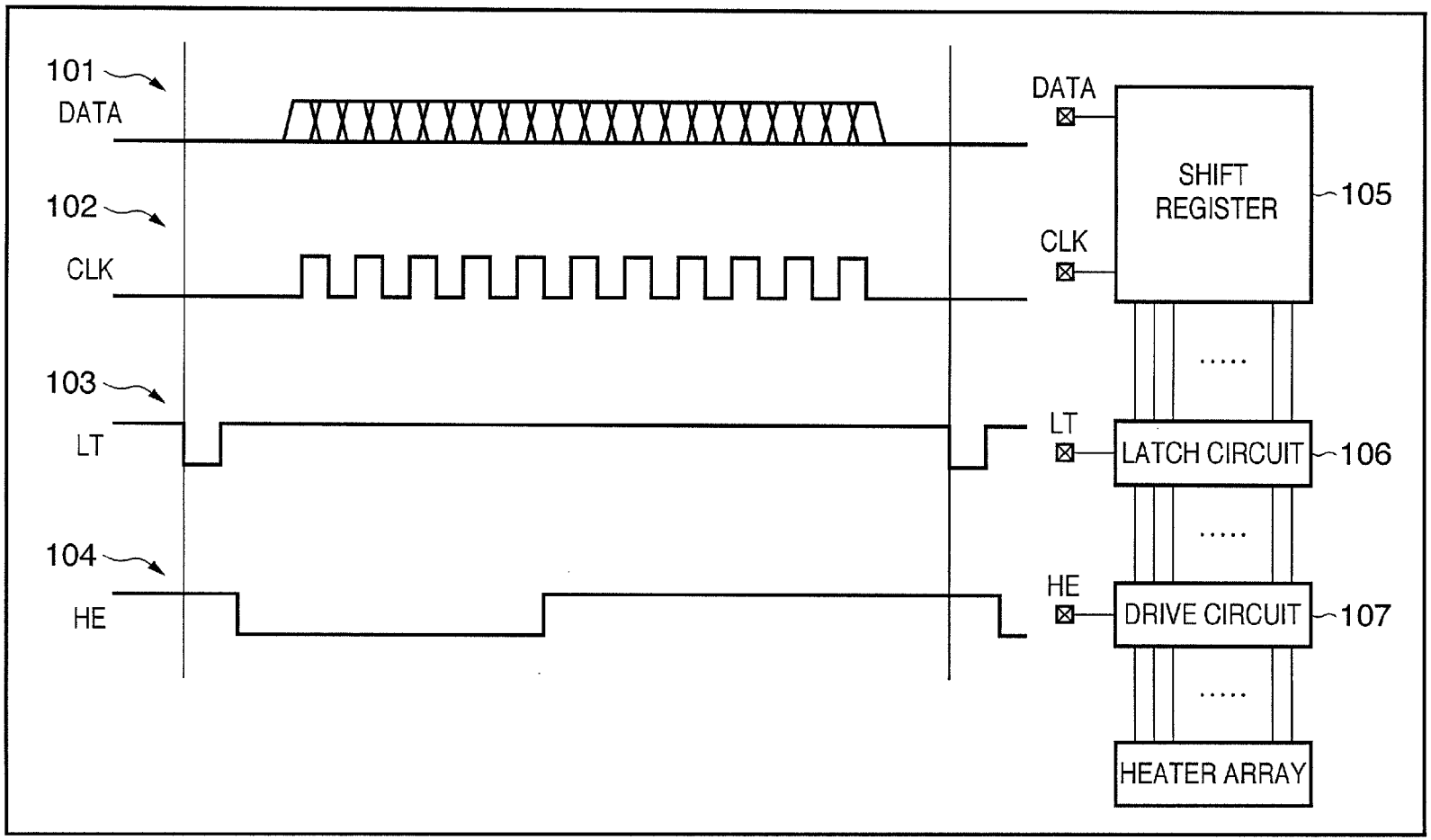
FIG. 1 PRIOR ART
FIG. 1 is a block diagram showing a circuit diagram of a conventional printhead and a timing chart of signals transmitted to the printhead from a printing apparatus.
Figure 2:
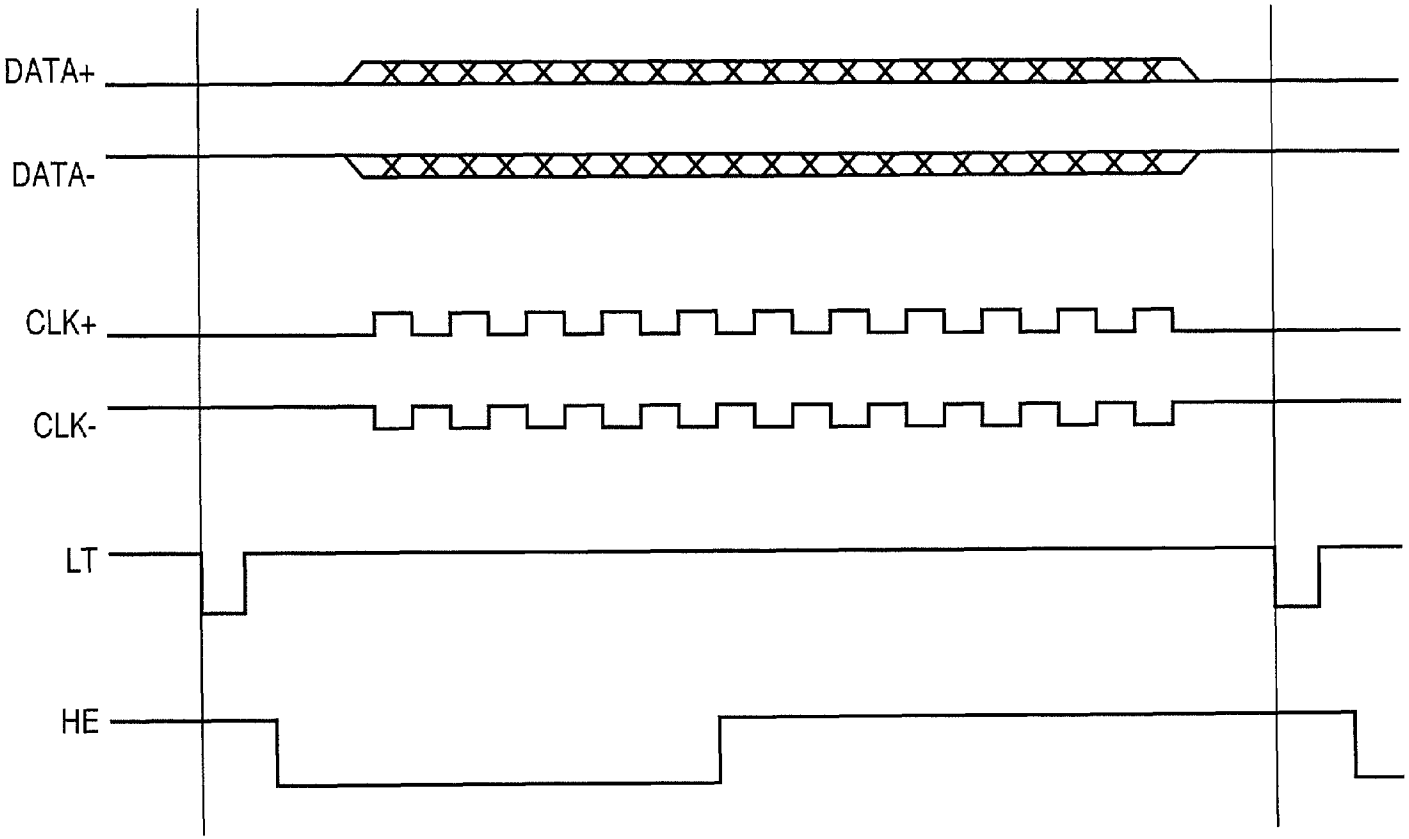
FIG. 2 PRIOR ART
FIG. 2 is a timing chart of signals input to a differential input circuit.
Figure 3:
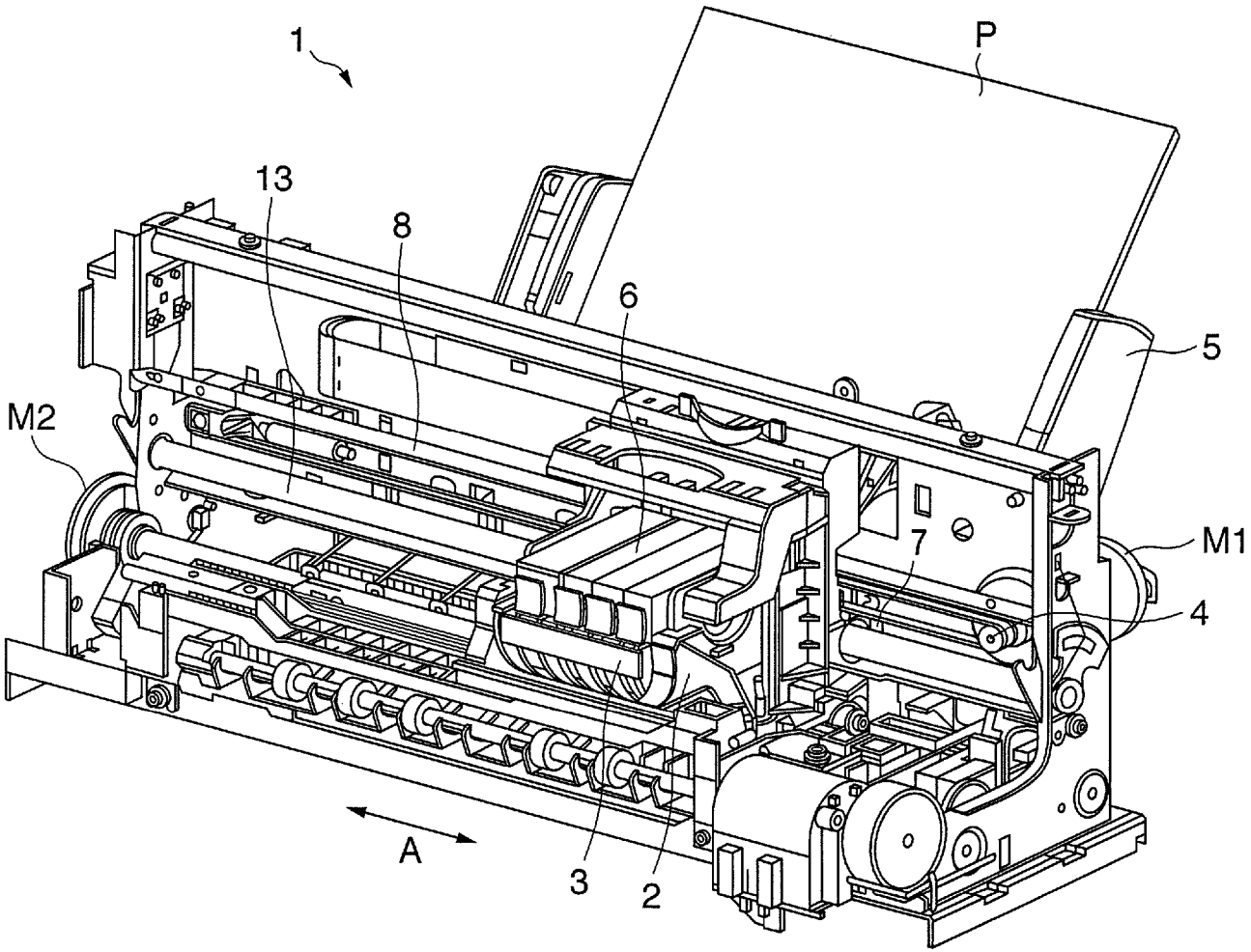
FIG. 3 is an outer perspective view showing an overview of the configuration of an inkjet printing apparatus that is a typical embodiment of the present invention.

Description of Inkjet Printing Apparatus (FIG. 3)

FIG. 3 is an outer perspective view showing an overview of the configuration of an inkjet printing apparatus 1 that is a typical embodiment of the present invention.

As shown in FIG. 3, a printhead 3 that performs printing by discharging ink according to an inkjet system is loaded in the inkjet printing apparatus (referred to below as a printing apparatus). A transmission mechanism 4 transmits driving force generated with a carriage motor M1 to a carriage 2 in which the printhead 3 is loaded, thus moving the carriage 2 back and forth in the direction of arrow A. Along with this back and forth movement, for example, a print medium P such as print paper is supplied via a paper supply mechanism 5 and transported to a printing position. At that printing position, printing is performed by discharging ink from the printhead 3 to the print medium P.

Loaded in the carriage 2 of the printing apparatus 1 is not only the printhead 3, but also ink cartridges 6 that store ink supplied to the printhead 3. The ink cartridges 6 are removable from the carriage 2.

The printing apparatus 1 shown in FIG. 3 is capable of color printing, and therefore four ink cartridges are loaded in the carriage 2 that respectively house magenta (M), cyan (C), yellow (Y), and black (K) inks. These four ink cartridges are each independently removable.

The joining faces of the carriage 2 and the printhead 3 are appropriately placed in contact, so that it is possible to achieve and maintain a required electrical connection. The printhead 3 prints by selectively discharging ink from a plurality of discharge orifices, by applying energy according to a printing signal. In particular, in the printhead 3 in this example, an inkjet system is adopted in which ink is discharged using thermal energy, and the printhead 3 is provided with electrothermal transducers in order to generate thermal energy. Electrical energy applied to the electrothermal transducers is converted to thermal energy. Using a pressure change that occurs due to the growth and contraction of bubbles due to film boiling that occurs due to application of the thermal energy to the ink, the ink is discharged from the discharge orifices. An electrothermal transducer is provided corresponding to each of the discharge orifices, and ink is discharged from a corresponding discharge orifice by applying a pulse voltage to a corresponding electrothermal transducer according to a printing signal.

An element substrate is disposed within the printhead, and the aforementioned electrothermal transducers are provided on the element substrate. Also provided on the element substrate are a shift register and a latch circuit that are logic circuits for selectively driving the electrothermal transducers, and a drive circuit and the like.

As described below, image data from outside the printhead is serially input to the shift register according to a clock signal, and after undergoing parallel conversion, the image data is held in the latch circuit according to a latch signal. The drive circuit is configured with an AND circuit, a switching transistor, and the like, and selectively drives the electrothermal transducers according to the image data held in the latch circuit and a time division signal.

As shown in FIG. 3, the carriage 2 is linked to a portion of a drive belt 7 of the transmission mechanism 4 that transmits driving force of the carriage motor M1, and is guidably supported so as to be capable of sliding along a guide shaft 13 in the direction of arrow A. Accordingly, the carriage 2 moves back and forth along the guide shaft 13 due to forward and reverse rotation of the carriage motor Ml. Also, a scale 8 is provided in order to indicate the position of the carriage 2 in the movement direction (the direction of arrow A) of the carriage 2.

Also, a platen (not shown) is provided in the printing apparatus 1 facing a discharge orifice face where the discharge orifices (not shown) of the printhead 3 are formed, and the carriage 2 loaded with the printhead 3 is moved back and forth by the driving force of the carriage motor M1. At the same time, by discharging ink by applying a printing signal to the printhead 3, printing is performed across the entire width of a print medium P that has been transported onto the platen.

Figure 4:
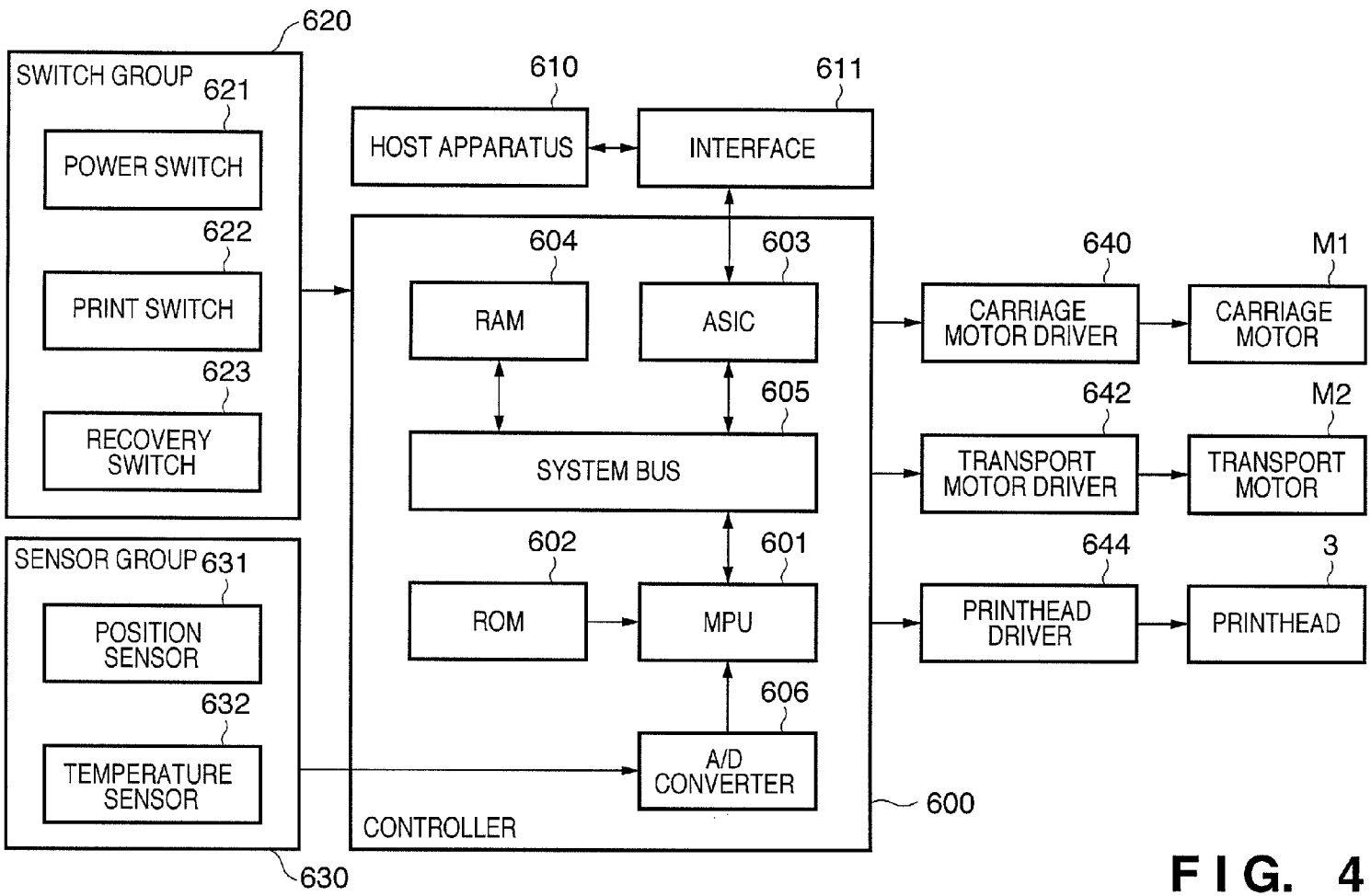
FIG. 4 is a block diagram showing the configuration of a control circuit of the printing apparatus.

Control Configuration of Inkjet Printing Apparatus (FIG. 4)

FIG. 4 is a block diagram showing the control configuration of the printing apparatus shown in FIG. 3.

As shown in FIG. 4, a controller 600 includes an MPU 601 and a ROM 602 in which a program corresponding to a control sequence described below, a required table, and other fixed data are stored. The controller 600 also includes an application specific integrated circuit (ASIC) 603 that generates control signals for control of the carriage motor M1, control of a transport motor M2, and control of the printhead 3. The controller 600 also includes a RAM 604 provided with an image data decompression area and a work area for program execution. The controller 600 also includes a system bus 605 whereby the MPU 601, the ASIC 603, and the RAM 604 are connected to each other, and data transfer is performed. Further, the controller 600 includes an A/D converter 606 that performs A/D conversion of an analog signal that has been input from a sensor group described below, and supplies a digital signal to the MPU 601.

Also, in FIG. 4, numeral 610 indicates a computer or the like that is a supply source of image data, referred to generally as a host apparatus. Image data, commands, status signals, and the like are transferred between the host apparatus 610 and the printing apparatus 1 via an interface (I/F) 611.

Numeral 620 indicates a switch group configured from switches or the like for receiving input of instructions from an operator, including a power switch 621, a print switch 622 for instructing print start, a recovery switch 623 for indicating to start recovery processing, and the like. Numeral 630 indicates a sensor group configured with a position sensor 631 such as a photocoupler, a temperature sensor 632, and the like.

Numeral 640 indicates a carriage motor driver that drives the carriage motor M1, and numeral 642 indicates a transport motor driver that drives the transport motor M2. Numeral 644 indicates a printhead driver that drives the printhead 3.

The ASIC 603 and the MPU 601 of the controller 600 of the main body of the printing apparatus, and the printhead driver 644, each independently create a differential signal in which two or more logic signals are superimposed. Also, the ASIC 603, the MPU 601, and the printhead driver 644, in multiple cooperation, create a differential signal in which two or more logical signals have been superimposed. When performing printing scanning with the printhead 3, these differential signals are transferred to the differential input circuit of the printhead 3 while directly accessing a storage area of the RAM 604. Specifically, for example, three or more logic signals are created with the ASIC 603, these logic signals are made into two superimposed signals that become a differential signal with the printhead driver 644, and this differential signal is transferred to the differential input circuit of the printhead 3. Here, a logic signal may be, for example, a data signal (DATA), a clock signal (CLK), a latch signal (LT), or a heat enable signal (HE).

In the configuration shown in FIG. 3, the ink cartridges 6 and the printhead 3 can be separated, but an exchangeable head cartridge may also be configured in which the ink cartridges 6 and the printhead 3 are formed as a single body.

Figure 5:
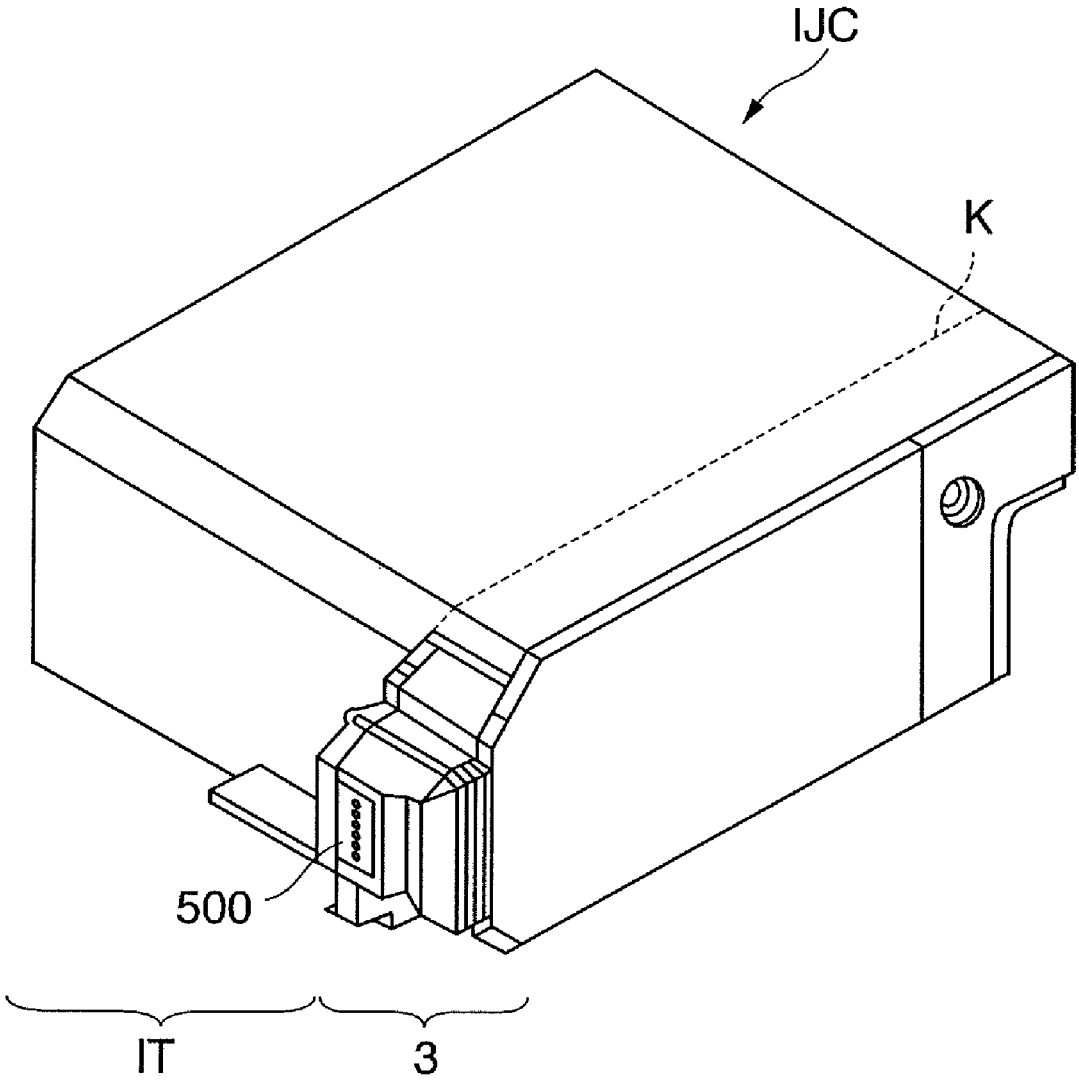
FIG. 5 is an external perspective view showing the configuration of a head cartridge IJC in which an ink tank and a printhead have been formed as a single body.

FIG. 5 is an external perspective view showing the configuration of a head cartridge IJC in which an ink tank and a printhead have been formed as a single body. In FIG. 5, the dotted line K is a boundary line of an ink tank IT and a printhead 3. The head cartridge IJC is provided with an electrode (not shown) for receiving an electrical signal such as the aforementioned differential signal provided from the carriage 2 when the head cartridge IJC has been loaded in the carriage 2. With this electrical signal, the printhead 3 is driven to discharge ink as described above.

In FIG. 5, numeral 500 indicates a line of ink discharge orifices.

Next, a more detailed description is given by way of a specific example.

EXAMPLE 1

Figure 6:
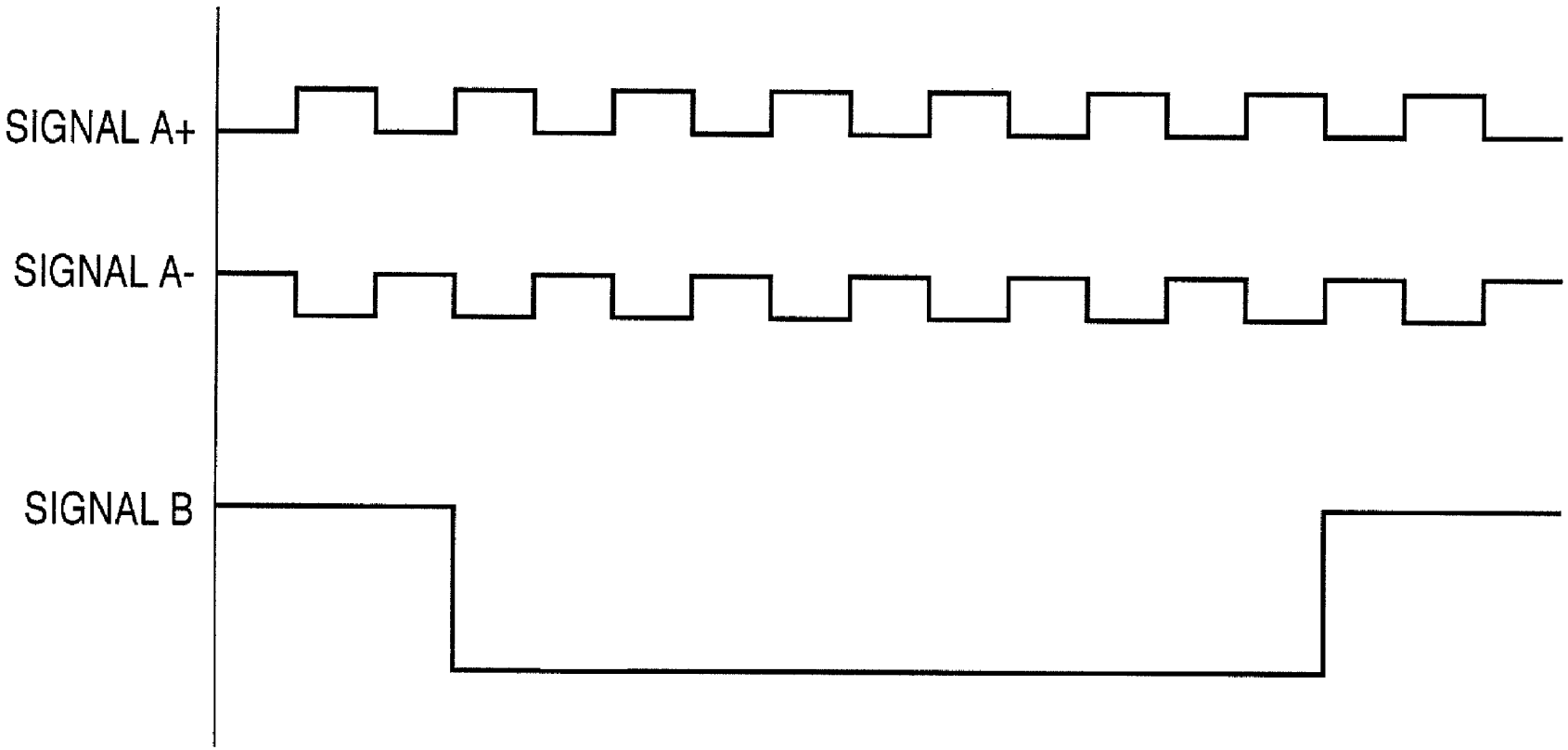
FIG. 6 shows a double-ended signal A and a single-ended signal B prior to being superimposed.
Figure 7:
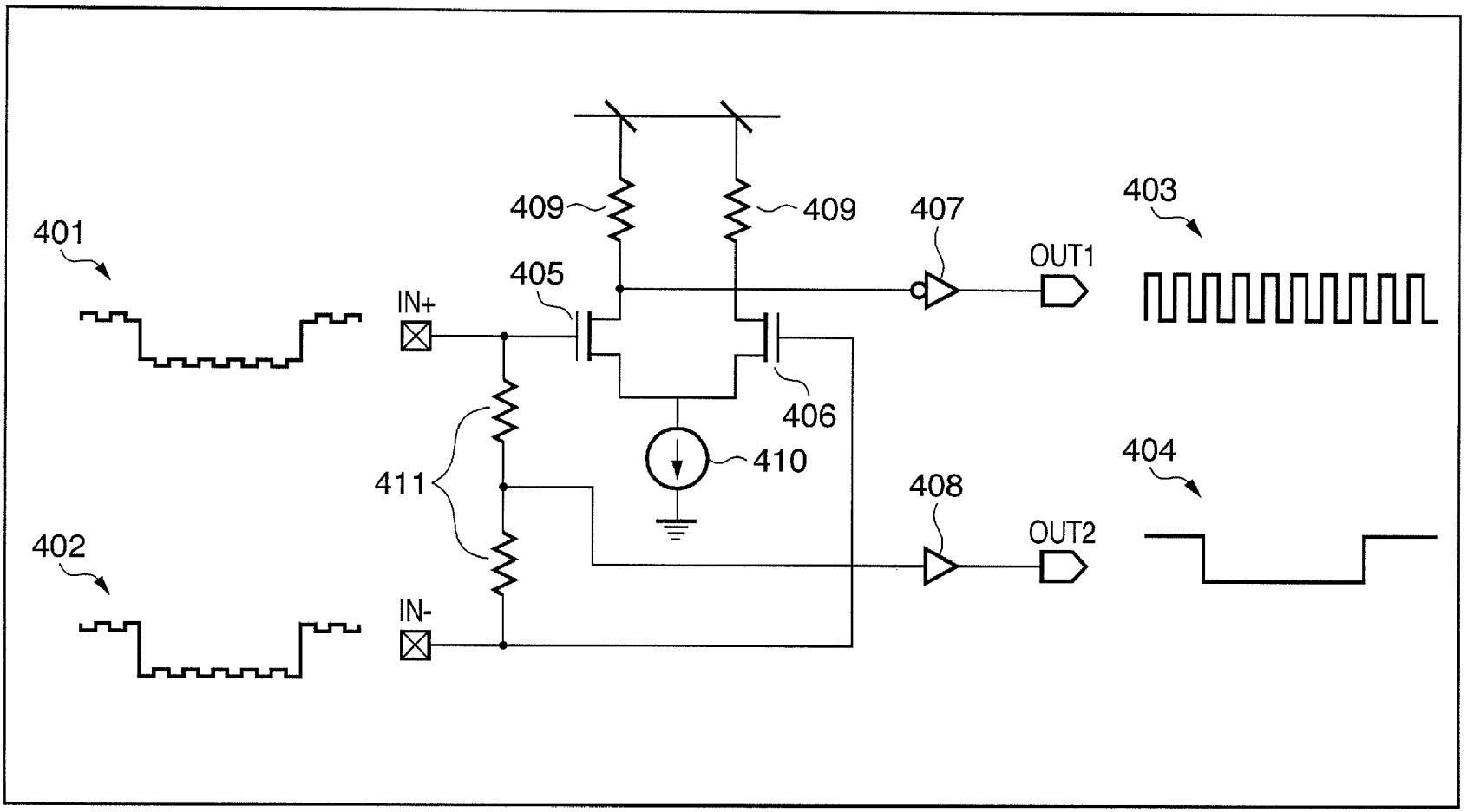
FIG. 7 shows a differential input circuit and superimposed input signals.

Following is a description of the differential input circuit and differential signal used in this example, provided in the form of an element substrate, with reference to the example in FIG. 7. The differential input circuit is configured from resistors 409 and 411, MOSs 405 and 406, a constant current source 410, and buffers 407 and 408. In an input signal, a low voltage differential signal (a double-ended pulse signal) has been superimposed on a single-ended pulse signal. As shown in FIG. 6, in a signal 401, a signal A+ has been superimposed on a signal B, and in a signal 402, a signal A− has been superimposed on the signal B.

Electrothermal transducers are provided on the element substrate of the invention, and a shift register and a latch circuit that are logic circuits for selectively driving the electrothermal transducers, and a drive circuit and the like, are provided on the element substrate. The printhead performs printing based on the image data, and the image data is serially input to the shift register according to the clock signal. After undergoing parallel conversion, the image data is held in the latch circuit according to a latch signal. The drive circuit selectively drives the electrothermal transducers according to a time determined from a heat enable signal, the image data held in the latch circuit, and a time-division signal.

The amplitude of the superimposed double-ended signals is not particularly limited as long as the amplitude is not greater than the driving voltage of the logic circuit. In this example, the potential of the single-ended pulse signal on which a low voltage differential signal is superimposed is used as a central potential, and the signal has a signal amplitude of about Vp−p=200 mV. The logic circuit is configured with a shift register, a latch circuit, and the like.

Also, the amplitude of the single-ended signal on which the low voltage differential signal is superimposed is a voltage of about half the driving voltage of the logic circuit.

The input superimposed signal has an amplitude that does not exceed a differential input voltage range.

The superimposed signals 401 and 402 satisfying the above conditions are respectively input to IN+ and IN−, which are input pads of the differential input circuit (FIG. 7) used in this example.

The signals are respectively input to the gates of the MOSs 405 and 406. When the difference between the signals 401 and 402 is positive, the MOS 405 is ON, and the MOS 406 is OFF. A low level signal is output to an OUT1. Conversely when the difference between the signals 401 and 402 is negative, the MOS 405 is OFF, so a high level signal is output to the OUT1.

The output signal is shaped by the buffer 407 to have a waveform like the signal 403. On the other hand, the signal output from an OUT2 is obtained by adding together the signals input to the input pads IN+ and IN−, so the concavities and convexities in the respective signals are filled in, and due to subsequent shaping by the buffer 408, the signal output from the OUT2 has a waveform like the signal 404.

By using a differential input circuit as shown in FIG. 7 in the above manner, it is possible to reduce the three pads in the case of not using a differential signal (signal A+ pad, signal A− pad, and signal B pad) to two pads (IN+, IN−).

Next, in FIG. 7, the output signal from the OUT2, being a signal in which superimposed signals are disassembled, is a signal in which the superimposed signals 401 and 402 are added, so unlike the signal output from the OUT1, the signal output from the OUT2 is mixed with noise generated, for example, in the signal transfer path to the printhead.

Figure 11:
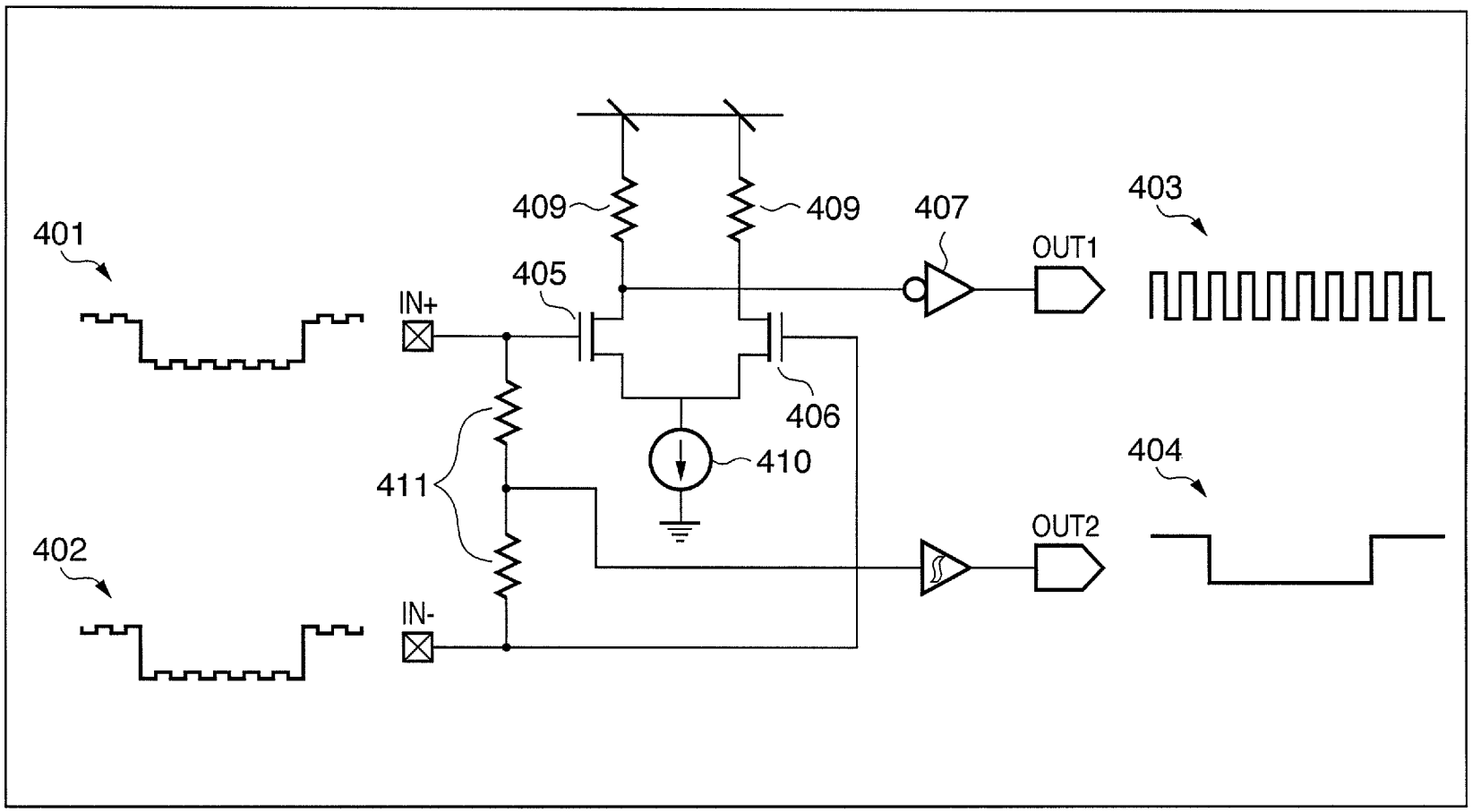
FIG. 11 shows a differential input circuit and superimposed input signals.

In the case of an analog signal such as a heat enable signal (HE) that determines the driving time of a heater, there is no actual effect even if noise is mixed into the signal, but in the case of a logic signal, logic may be reversed by noise. In order to prevent such a reversal of logic, in the configuration shown in FIG. 11, an inverter of the output signal of the OUT2 is provided with a hysteresis property, and thus the configuration is robust with respect to noise.

Figure 8:
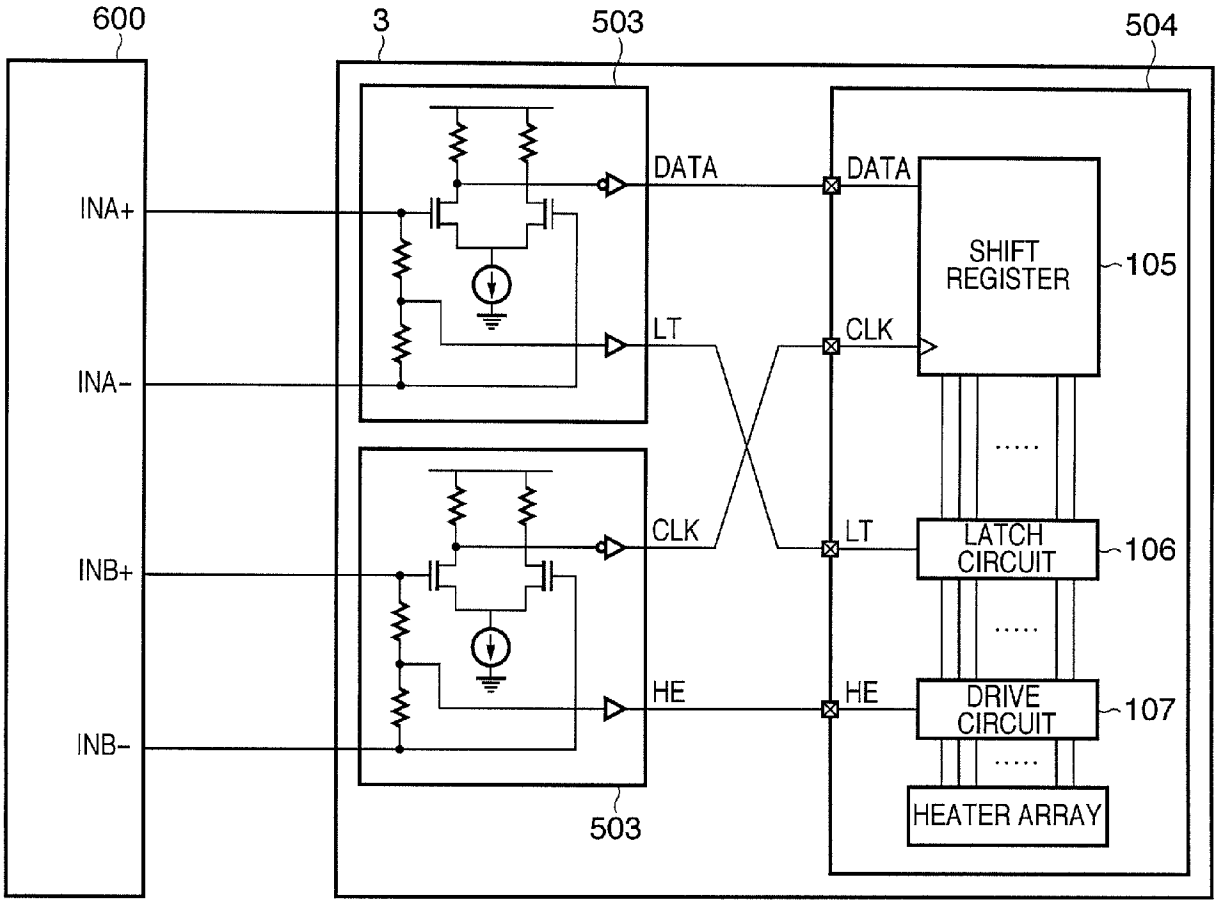
FIG. 8 is a block diagram of a head controller and printhead of the main body of a printing apparatus with a differential input circuit and a logic circuit configured on separate element substrates.

FIG. 8 shows a block diagram of this example.

Here, the drawing is simplified by extracting only the part related to signal transmission, that is a distinguishing characteristic of the invention, and shows the controller 600 included in the main body of the printing apparatus, and the element substrate used to configure the printhead 3.

A signal obtained by superimposing two or more logic signals is output from the controller 600 of the main body of the printing apparatus.

A logic circuit 504 includes a heater array constituting a printing element and a drive circuit for the heater array, a latch circuit, and a shift register that are formed on the same element substrate. A differential input circuit 503 is the differential input circuit shown in FIG. 7, and is formed on a separate substrate from the logic circuit 504. The hysteresis output configuration shown in FIG. 11 may be adopted for a portion of an LT signal output stage in a circuit structure that is subjected to logic reversal due to noise.

Figure 9:
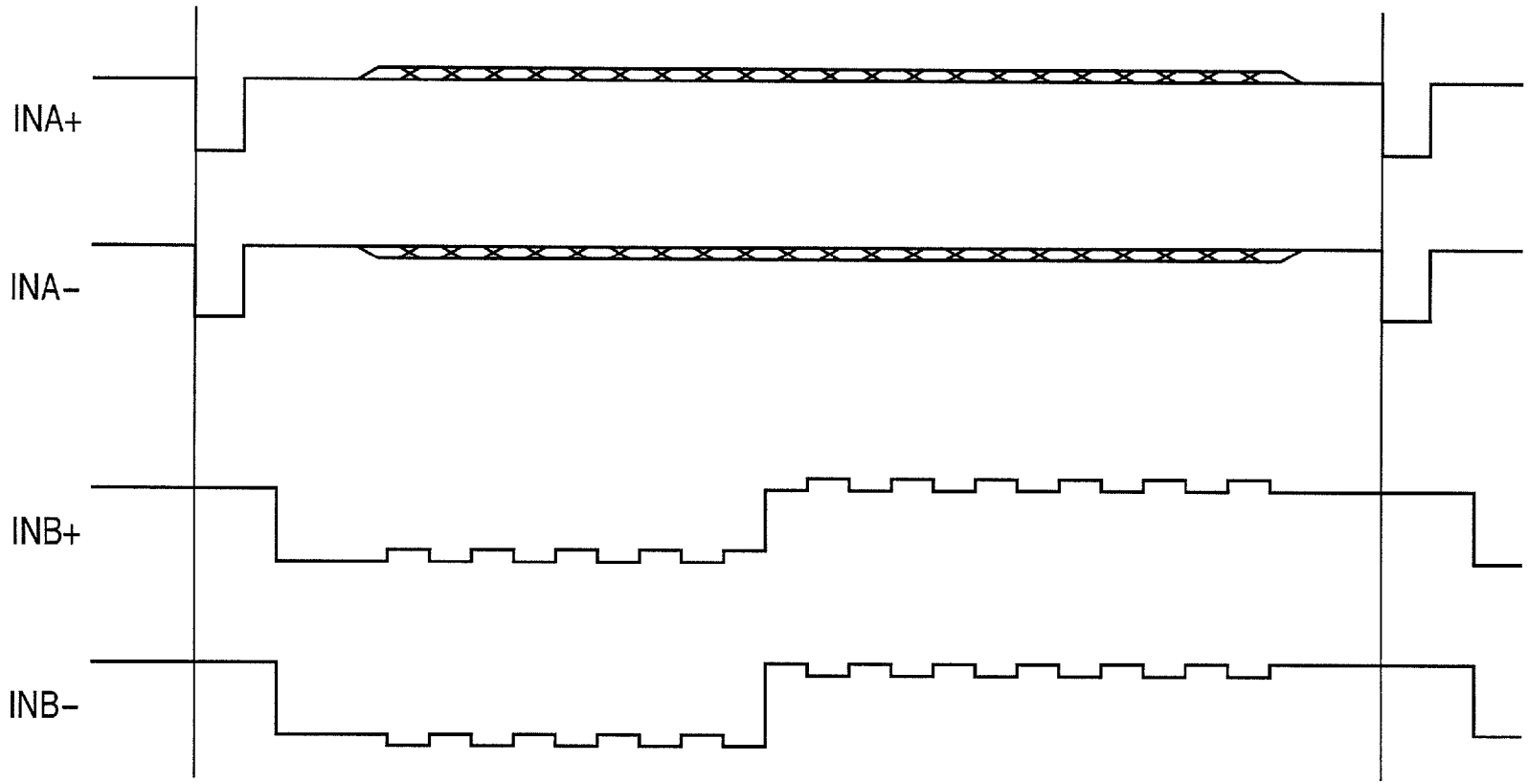
FIG. 9 is a timing chart of signals in which a DATA signal and a CLK signal transferred to a printhead are double-ended signals, and superimposed on an LT signal and an HE signal.

Signals INA+, INA−, and INB+, INB− that are input to the printhead 3 are shown in FIG. 9.

It is desirable that signals to be superimposed (made double-ended) are high frequency signals such as a DATA signal and a CLK signal. By making these signals double-ended, it is possible to further anticipate results such as suppression of electromagnetic radiation and improvement of robustness with respect to noise in signal transfer between the controller 600 and the printhead 3.

In this example, INA+ and INA− are signals in which a DATA signal is superimposed on an LT signal (three logic signals, namely a DATA+ signal, a DATA− signal, and an LT signal, become a superimposed signal in which the DATA+ signal is superimposed on the LT signal (INA+), and a superimposed signal in which the DATA− signal is superimposed on the LT signal (INA−)). INB+ and INB− are signals in which a CLK signal is superimposed on an HE signal (three logic signals, namely a CLK+ signal, a CLK− signal, and an HE signal, become a superimposed signal in which the CLK+ signal is superimposed on the HE signal (INB+), and a superimposed signal in which the CLK− signal is superimposed on the HE signal (INB−)).

These signals are transferred via differential data transfer that has excellent robustness with respect to noise, and little electromagnetic radiation, and input to the differential input circuit 503. After being respectively converted into a DATA signal, an LT signal, a CLK signal, and an HE signal, these signals are input to a terminal of a conventional printing element, and connected to the shift register 105, the latch circuit 106, and the drive circuit 107, which are logic circuits.

In the above manner, in this example, it is possible to reduce the six input pads from the DATA+ signal, the DATA− signal, the LT signal, the CLK+ signal, the CLK− signal, and the LT signal to the four input pads from the signals INA+, INA−, INB+, and INB−. Also, in this example, by providing the logic circuit and the differential input circuit on separate substrates, there is more freedom with respect to arrangement of the respective substrates, and also arrangement of connectors and wiring and the like, resulting in increased freedom of design.

EXAMPLE 2

In this example, unlike in Example 1, a configuration is provided in which the differential input circuit and the logic circuit are on the same substrate.

Figure 10:
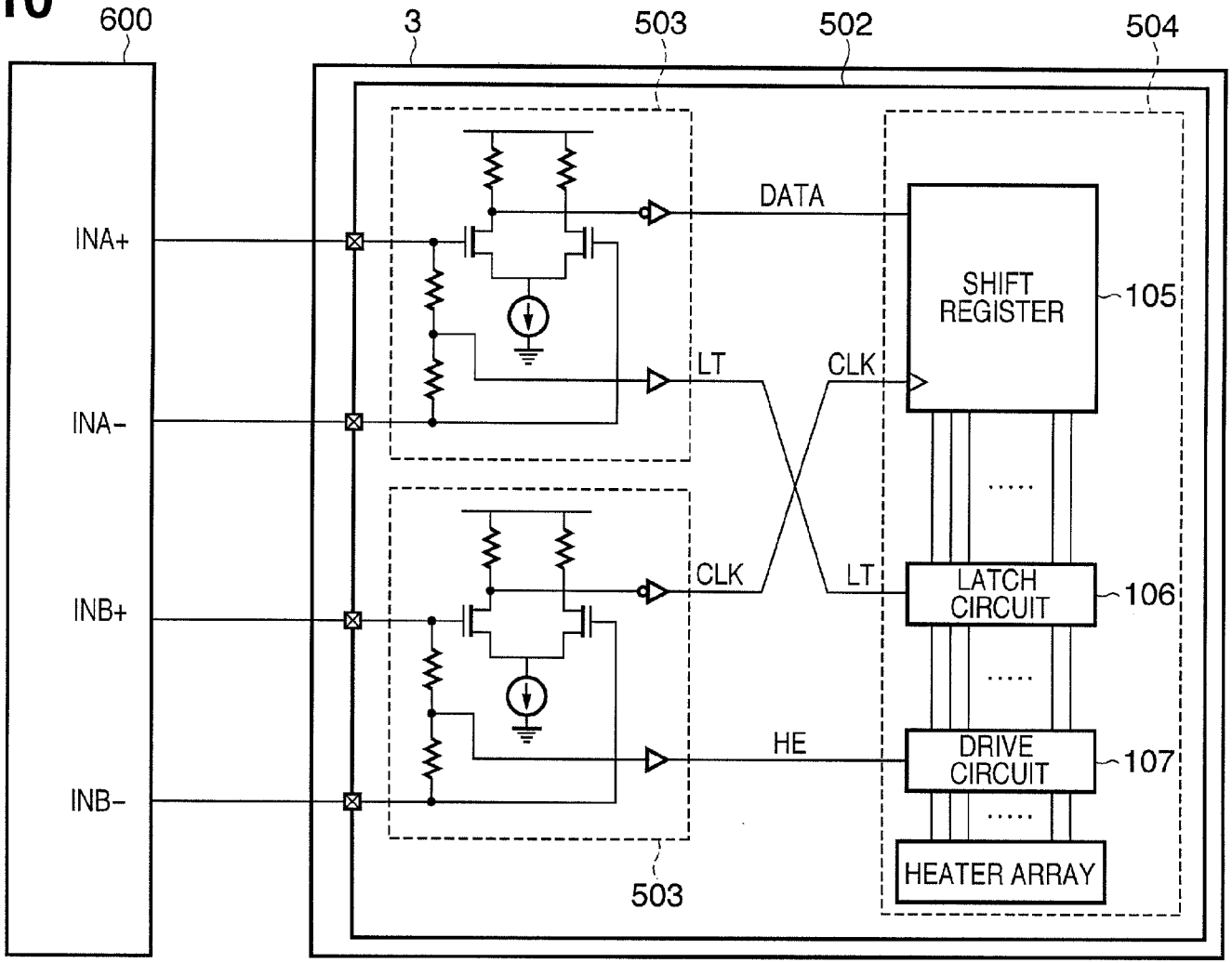
FIG. 10 is a block diagram of a head controller and printhead of the main body of a printing apparatus with a differential input circuit and a logic circuit configured on the same element substrate.

FIG. 10 is a block diagram showing the characteristics of Example 2 of the invention.

In this example, the data and timing charts of that data are the same as in Example 1, so a description thereof is omitted here.

The logic circuit 504 includes a heater array constituting a printing element and a drive circuit for the heater array, a latch circuit, and a shift register, and on the same substrate 502, the same differential input circuit 503 as in Example 1 is configured. The hysteresis output configuration shown in FIG. 11 may be adopted for a portion of an LT signal output stage in a circuit structure that is subjected to logic reversal due to noise.

In the above manner, in this example, it is possible to reduce the six input pads from the DATA+ signal, the DATA− signal, the LT signal, the CLK+ signal, the CLK− signal, and the LT signal to the four input pads from the signals INA+, INA−, INB+, and INB−. Also, by adopting this configuration, reduced cost is possible due to a reduction in the number of components, a reduction in the total print substrate size, and the like.

In the above examples, a means is provided for generating thermal energy as energy used for allowing ink discharge to be performed, and by employing a system in which a change in the state of ink is caused using that thermal energy, greater density and greater definition are attainable. As a means for generating thermal energy, for example, an electrothermal transducer or the like may be used.

In addition, as an embodiment of a printing apparatus according to the invention, other than an apparatus provided integrated or separately as an image output terminal of an information processing device such as a computer, an embodiment of a copy apparatus combined with a reader or the like may also be adopted. Further, an embodiment of a facsimile apparatus having send-receive functions may also be adopted.

With the invention, as described above, it is possible to attain transfer of a high frequency clock signal, a high frequency data signal, and the like necessary for realizing high speed driving of the printhead, while suppressing the effects of electromagnetic radiation or the like.

Also, when these high frequency signals pass through a comparatively long flexible cable, electromagnetic radiation becomes a problem. With the invention, it is possible to suppress effects due to reducing the voltage amplitude of transmission signals.

Also, with the invention, by superimposing two or more logic signals, in the above differential data transfer, it is possible to suppress an increase in the number of transmitted signals, the number of input signals, the number of input terminals, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-178585, filed Jun. 28, 2006, which is hereby incorporated by reference herein in its entirety.

What is claimed is:

1. A printhead comprising:

a circuit that controls driving of a plurality of print elements with a plurality of signals including a clock signal and a heat enable signal; and an input circuit that has a first input pad for inputting a first signal obtained by combining a first clock signal and the heat enable signal, a second input pad for inputting a second signal obtained by combining the heat enable signal and a second clock signal whose phase is opposite to the phase of the first clock signal, a first generating circuit for generating the clock signal and outputting the clock signal for the circuit, and a second generating circuit for generating the heat enable signal and outputting the heat enable signal for the circuit, wherein the first generating circuit includes a differential circuit that inputs the first signal and the second signal, and wherein the second generating circuit includes a first resistor and a second resistor, the first resistor and the second resistor are connected in series between the first input pad and the second input pad, and the heat enable signal is generated at connection of the first resistor and the second resistor.

2. The printhead according to claim 1, wherein the circuit including a shift register inputs a data signal transmitted in synchronization with the clock signal and a drive circuit drives the plurality of print elements based on the heat enable signal.

3. The printhead according to claim 2, wherein the circuit includes a latch circuit which, based on a latch signal, latches the data signal inputted into the shift register.

4. The printhead according to claim 1, wherein the printhead is for use in a thermal inkjet printing apparatus that performs ink foaming and discharge with thermal energy generated by current applied to an electrothermal transducer.

5. A printing apparatus that performs printing using the printhead according to claim 1, the printing apparatus comprising:

a signal generating unit that generates the first signal obtained by combining the first clock signal and the heat enable signal, and generates the second signal obtained by combining the second clock signal and the heat enable signal; and an output unit that outputs the first signal and the second signal generated by the signal generating unit to the printhead.

6. The printhead according to claim 1, wherein the plurality of signals includes a data signal and a latch signal, the input circuit that has a third input pad for inputting a third signal obtained by combining a first data signal and the latch signal, a fourth input pad for inputting a fourth signal obtained by combining the latch signal and a second data signal whose phase is opposite to the phase of the first data signal, a third generating circuit for generating the data signal and outputting the data signal for the circuit, and a fourth generating circuit for generating the latch signal and outputting the latch signal for the circuit, wherein the third generating circuit includes a differential circuit that inputs the third signal and the fourth signal, and the data signal is generated in the differential circuit, wherein the fourth generating circuit includes a third resistor and a fourth resistor, the third resistor and the fourth resistor are connected in series between the third input pad and the fourth input pad, and the latch signal is generated at connection of the third resistor and the fourth resistor.

7. A printhead comprising:

a circuit that controls driving of a plurality of print elements with a plurality of signals including a data signal and a latch signal; and an input circuit that has a first input pad for inputting a first signal obtained by combining a first data signal and the latch signal, a second input pad for inputting a second signal obtained by combining the latch signal and a second data signal whose phase is opposite to the phase of the first data signal, a first generating circuit for generating the data signal and outputting the data signal for the circuit, and a second generating circuit for generating the latch signal and outputting the latch signal for the circuit, wherein the first generating circuit includes a differential circuit that inputs the first signal and the second signal, and the data signal is generated in the differential circuit, and wherein the second generating circuit includes a first resistor and a second resistor, the first resistor and the second resistor are connected in series between the first input pad and the second input pad, and the latch signal is generated at connection of the first resistor and the second resistor.

* * * * *